US005676268A

United States Patent [19]

King

[11] Patent Number: 5,676,268

[45] Date of Patent: Oct. 14, 1997

[54] CHILD-RESISTANT CLOSURE WITH CASTELLATIONS

[75] Inventor: Roger Milner King, Latimer, United Kingdom

[73] Assignee: Beeson and Sons Limited, Rickmansworth, United Kingdom

[21] Appl. No.: 477,903

[22] Filed: Jun. 7, 1995

Related U.S. Application Data

[62] Division of Ser. No. 380,201, Jan. 30, 1995, Pat. No. 5,588,545, which is a continuation of Ser. No. 121,970, Sep. 15, 1993, abandoned, which is a continuation of Ser. No. 796,946, Nov. 22, 1991, abandoned.

[30] Foreign Application Priority Data

| | | | |
|---|---|---|---|
| Sep. 23, 1991 | [GB] | United Kingdom | 9120264 |
| Oct. 17, 1991 | [GB] | United Kingdom | 9122097 |

[51] Int. Cl.[6] ..... B65D 55/02

[52] U.S. Cl. ..... 215/216; 215/217; 215/218

[58] Field of Search ..... 215/216, 217, 215/218, 219, 220, 329, 330, 331, 305, 252

[56] References Cited

U.S. PATENT DOCUMENTS

| | | | |
|---|---|---|---|
| D. 207,887 | 6/1967 | Parsisson . | |
| D. 327,644 | 7/1992 | Offley et al. . | |
| D. 329,980 | 10/1992 | Powell et al. . | |
| 2,568,436 | 9/1951 | Faria | 224/45 |
| 2,572,486 | 10/1951 | Isaac | 220/38 |
| 3,770,153 | 11/1973 | Gach et al. . | |
| 3,795,337 | 3/1974 | Nozawa | 215/219 |
| 3,907,155 | 9/1975 | Smith et al. . | |
| 3,944,102 | 3/1976 | Grau . | |
| 4,011,829 | 3/1977 | Wachsmann et al. . | |
| 4,093,096 | 6/1978 | Augros . | |
| 4,213,534 | 7/1980 | Montgomery . | |
| 4,413,743 | 11/1983 | Summers . | |
| 4,469,235 | 9/1984 | Parker | 215/295 |
| 4,480,760 | 11/1984 | Schonberger . | |
| 4,527,701 | 7/1985 | Schaubeck . | |
| 4,562,931 | 1/1986 | Brach et al. | 215/220 |
| 4,570,809 | 2/1986 | Archer | 215/220 |
| 4,624,377 | 11/1986 | Wassilieff | 215/220 |
| 4,653,672 | 3/1987 | Tuerk et al. | 222/153 |
| 4,754,892 | 7/1988 | Retief . | |
| 4,782,965 | 11/1988 | Wassilieff . | |

(List continued on next page.)

FOREIGN PATENT DOCUMENTS

| | | |
|---|---|---|
| 0 182 519 | 5/1986 | European Pat. Off. . |
| 0 443 868 | 8/1991 | European Pat. Off. . |
| 724431 | 4/1932 | France . |
| 2153305 | 5/1973 | France . |
| 1 438 885 | 6/1976 | United Kingdom . |
| 2 011 869 | 7/1979 | United Kingdom . |
| 1 603 667 | 11/1981 | United Kingdom . |
| 2 114 552 | 8/1983 | United Kingdom . |
| 2 155 447 | 9/1985 | United Kingdom . |
| 2 203 729 | 10/1988 | United Kingdom . |

OTHER PUBLICATIONS

U.S. application Serial No. 08/380,201 filed Jan. 30, 1995 by King (Our Docket No. 4862/26).

*Primary Examiner*—Jes F. Pascua

*Attorney, Agent, or Firm*—Brinks Hofer Gilson & Lione

[57] ABSTRACT

A container neck and child-resistant closure for the neck are disclosed. The closure includes an inner part and an outer part, and castellations on the parts which mate when the outer part is displaced axially, to lock the parts together for rotation. A ratchet mechanism including ratchet ramps and cantilever leaf springs biases the inner and outer parts axially and rotationally apart, and allows relative rotation of the parts in one direction of rotation, when the castellations are not engaged. The angle through which outer part has to be turned to enable the castellations to be engaged may be less than 45° and preferably less than 25°. The closure may be moved between fully opened and closed positions by rotation through less than 360° and preferably about 90°. A tamper-evident ring, and a retaining means for retaining the closure in the closed position, may also be provided.

4 Claims, 5 Drawing Sheets

U.S. PATENT DOCUMENTS

| | | | |
|---|---|---|---|
| 4,801,028 | 1/1989 | Puresevic et al. | 215/220 |
| 4,873,100 | 10/1989 | Dirksing et al. | 426/111 |
| 4,957,210 | 9/1990 | Kusz . | |
| 5,009,338 | 4/1991 | Barker . | |
| 5,020,681 | 6/1991 | Kusz . | |
| 5,103,991 | 4/1992 | Collins . | |
| 5,213,225 | 5/1993 | King et al. . | |
| 5,219,084 | 6/1993 | King . | |
| 5,411,157 | 5/1995 | King et al. . | |
| 5,454,476 | 10/1995 | King et al. | 215/330 |
| 5,588,545 | 12/1996 | King | 215/216 |
| 5,590,799 | 1/1997 | King | 215/216 |

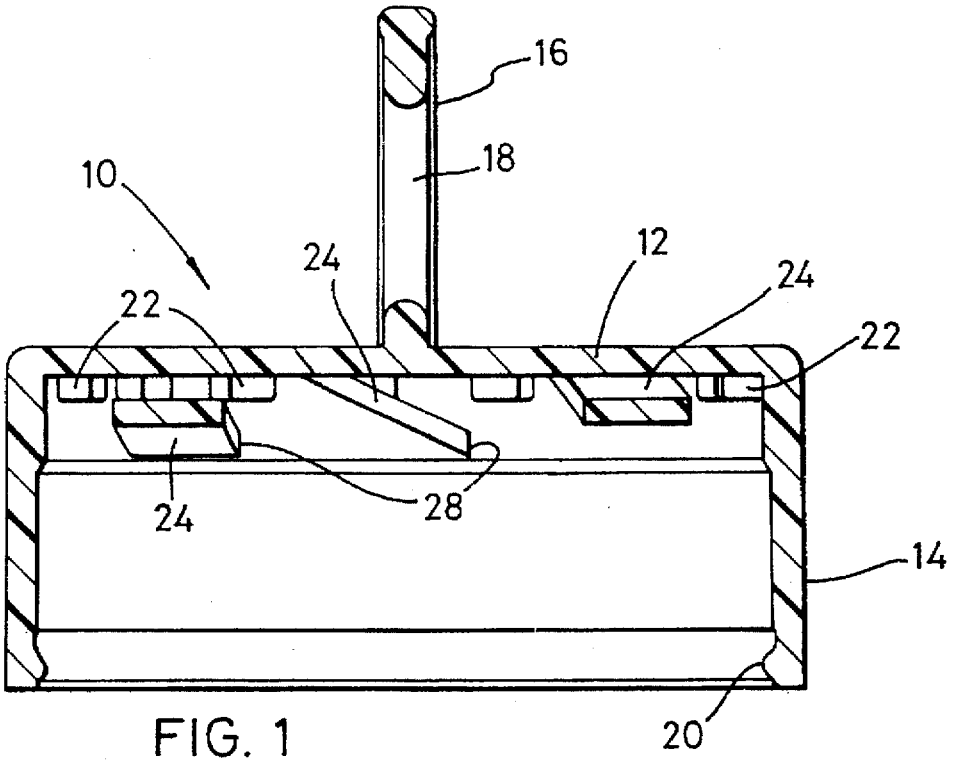
FIG. 1
FIG. 2
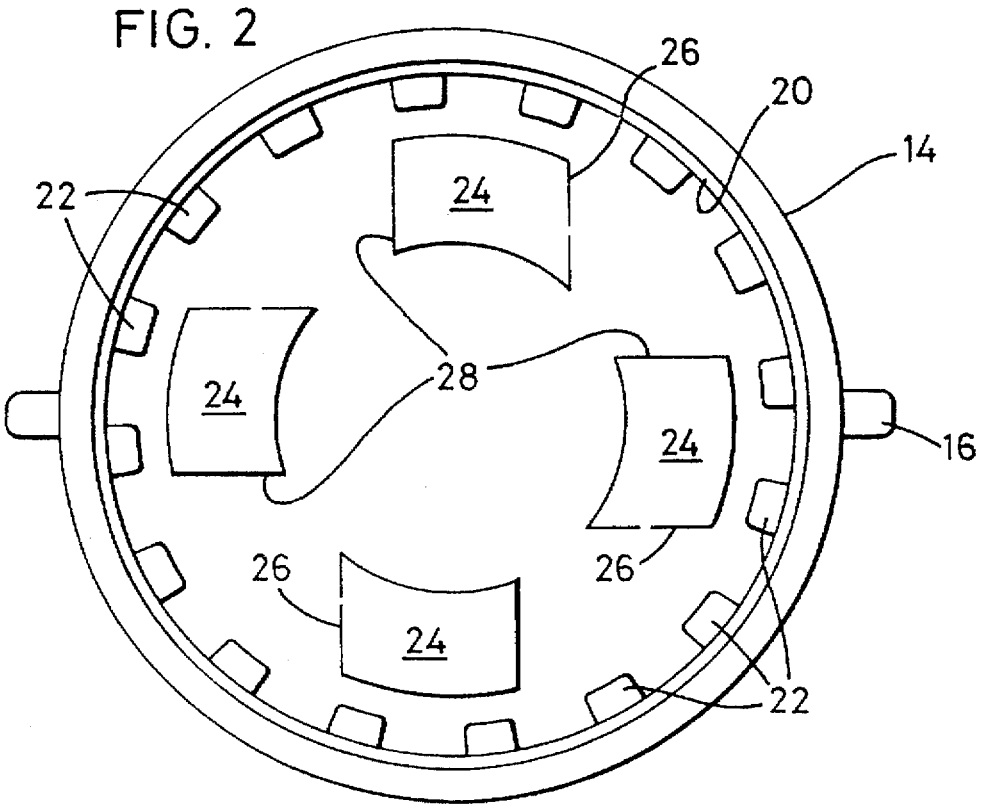

CHILD-RESISTANT CLOSURE WITH CASTELLATIONS

This application is a division of application Ser. No. 08/380,201, filed Jan. 30, 1995, now U.S. Pat. No. 5,588,545, which is a continuation of application Ser. No. 08/121,970, filed Sep. 15, 1993, now abandoned, which is a continuation of application Ser. No. 07/796,946, filed Nov. 22, 1991, now abandoned.

The invention relates to closures for containers.

In this specification, a so-called "child-resistant" closure (hereinafter referred to as a "relevant child-resistant closure") comprises an inner closure part adapted to be engaged with the neck of a container by rotation in one sense and to be disengaged therefrom by rotation in the other sense; an outer closure part capable of being moved relative to the inner closure part between a predetermined rest position and a displaced position; means to rotate the inner closure part with the outer closure part on rotation of the latter in the said one sense when the outer closure part is in either of its rest position and its displaced position; and means to rotate the inner closure part with the outer closure part on rotation of the latter in the said other sense when the outer closure part is in its displaced position, but when the outer closure part is in its rest position only when any torque resisting rotation of the inner closure part is below a predetermined threshold; wherein the outer closure part is capable of adopting its displaced position only when its angular displacement with respect to the inner closure part is within any one of a number of predetermined discrete angular ranges. It will be appreciated that the term "discrete angular ranges" covers the case where the ranges are zero, and the outer closure part can adopt its displaced position only at discrete angles relative to the inner closure part.

The closure according to the invention is particularly suitable for use in the arrangement described in U.S. patent application Ser. No. 706,891 and/or that described in U.S. patent application filed 30th Sep., 1991 Ser. No. 769,198, corresponding to U.K. Patent Application No. 9114871.8, the disclosures of which applications are included herein by way of reference.

Many known child-resistant closures include a plurality of equidistant ramps on the outer surface of a crown portion of the inner closure part which cooperate with a plurality of equidistant, resilient oblique blades extending inwardly from a crown portion of the outer closure part. When viewed from the centre of the respective closure parts, the ramps have a right triangular section comprising a horizontal base, a vertical left side and a hypotenuse and the blades extend diagonally downward from the left towards a lower right free end.

When the outer closure part is rotated clockwise, i.e. in a right-handed sense, the free ends of the blades abut the vertical faces of the ramps, thereby driving the inner closure part with the outer closure part.

When rotation of the outer closure part is effected in the other, left-handed sense, i.e. anticlockwise, the blades simply trail over the ramps in the manner of a ratchet, the inner closure part being fixed on the container by its closure torque.

Typically, castellations are provided on both inner and outer closure parts which mate when the outer closure part is depressed. The inner closure part is then bound to rotate with the outer closure part. When the outer closure part is released, the blades act as leaf springs to return it to its rest position, in which the castellations are disengaged.

Child-resistant closure systems normally rely on the ability of the closure to spring apart, every time, after pressure has been applied, generally at right angles to the plane of the thread. If, even on rare occasions the two parts of the closure do not spring apart and disengage, the child-resistant feature of the closure no longer functions. It is therefore essential that the blades acting as leaf springs have and continue to retain sufficient resilience to exert sufficient pressure to force the two parts of the closure apart in order that there is disengagement at all times, apart from occasions when direct and sufficient pressure is applied to engage the closure system. The main failure of existing systems to work properly at all times is due to the weakness of the leaf springs which in the past have typically been made of uniform thickness, with a sharp angle on the inside edge where the leaf spring joins the flat face of the underside of the top part of the closure. This design is potentially unsatisfactory as the leaf springs can weaken at the point of joining the flat plane of the Underside of the top part of the closure, and the leaves themselves tend to be stiff and as a result do not flex along the length of the spring leaf. To overcome this problem and to ensure more flexibility and to ensure that the leaf springs retain their resilience and hence the ability to force the two parts of the closure apart, and also to ensure that when being closed the planes of the top and lower part of the closure remain in parallel planes, the invention provides a relevant child-resistant closure comprising a plurality of cantilever leaf springs extending obliquely from one part of the closure towards the other part of the closure, each cantilever leaf spring having a cross-section which tapers towards its free end, and the profile at the acute angle between each cantilever leaf spring and the closure part from which said spring extends is radiused.

Another problem arises where a closure is primarily intended for use by the elderly, and hence must be easy to open, but which, for safety, must be child-resistant. The number of castellations provided on known child-resistant closures is normally two, three or four, but this can require the closure to be rotated for up to 180° before engagement of the castellations can take place. Engagement after a much smaller rotation is desirable, and according to a further aspect of the invention there is provided a container neck and closure therefor wherein the closure moves from fully closed to a fully open position by relative rotation through less than 360°, preferably approximately 90° or less, the closure being a relevant child-resistant closure and the number of said predetermined discrete angular ranges being such that angular displacement of the outer closure member relative to the inner closure member between adjacent positions in which the outer closure member can move to its displaced position is not greater than 45°, and preferably not greater than 25°. A preferred angular displacement is 22.5°, in which case, from a normal rest position, the outer closure would move to a position where it could be moved with its displaced position by rotation through 12.25° relative to the inner closure member. This preferred arrangement is provided by the closure having sixteen castellations, in which the maximum turn required for engagement is only one sixteenth, i.e. 22.5°. This is an important feature when used in conjunction with the container and closure of U.S. patent application Ser. No. 706,891, where, in the preferred embodiment, the closure can be removed in only a quarter turn, and the addition of the child-resistant feature does not reduce the capacity to open the closure in approximately a quarter turn. This aspect particularly assists and supports ease of opening for the elderly and frail with only a twist of the wrists, without the necessity to let go of the closure of the container, even though being child-resistant.

The number of ramps in known closures varies, but is commonly three, four or six. The number of blades should be greater than two for stability, and should be a factor of the number of ramps.

In the past it has been arranged that the discrete angular ranges of angular displacement of the closure parts at which the castellations may engage one another is one in which the free ends of the blades on the outer closure part lie between ramps on the inner closure part.

A result of this is that it is perfectly possible for a container on which such a closure is installed to be left with the closure parts so oriented that the castellations may be engaged simply by immediate depression of the outer closure part. Such a situation can occur where a closure has been installed with the outer closure part depressed, or where an adult has depressed the outer closure part, but then changed his mind about removing the closure.

The present invention seeks to overcome the above problem and according to a further aspect of the invention provides a relevant child-resistant closure comprising means for biassing rotationally the outer closure part relative to the inner closure part from each angular displacement at which the outer closure part can adopt its displaced position to a respective angular displacement at which the outer closure, part cannot adopt its displaced position. Preferably, the rotational biassing means exert a torque which is greater in absolute value than any frictional torque resisting relative rotation of the closure parts.

In the preferred case, at no time can the closure of the invention be left in a condition at which immediate movement of the outer closure part from its rest position to its displaced position is possible. The outer closure part must first be rotated against some restoring force before such displacement can be effected.

In the case where the friction between closure parts is sufficient to resist the restoring torque, enabling the closure to be left in a "primed" condition as it were, an advantage still obtains. Subsequent handling of the closure or the container to which the closure is attached, such as setting the container down, dropping it, picking it up, casting it into a "medicine box", will in most cases be sufficient to cause the outer closure part to move somewhat relative to the inner closure part. The outer closure part will then come to rest nearer to, if not actually at, the said respective angular displacement.

It is therefore extremely difficult, in normal usage, to leave the closure in a "primed" condition.

Preferably, the means to rotate the inner closure part with the outer closure part comprises a ratchet mechanism which restricts rotation of the outer closure part relative to the inner closure part in the said one sense, but permits such rotation in the said other sense.

Preferably, the rotational biassing means comprises the ratchet mechanism.

Preferably, the number of the said discrete angular ranges is equal to the number of stable positions of the ratchet mechanism. When the closure is for use in an arrangement as disclosed in U.S. patent application Ser. No. 706,891, it is advantageous for the number of the said discrete angular ranges to be at least eight, preferably sixteen. This preserves the ability of the closure to be removed with a relatively small amount of rotation.

According to a further aspect of the invention, there is provided a container and closure as claimed in U.S. patent application Ser. No. 706,891 or according to the invention of this application wherein the container neck and the container closure have fully engaging thread profiles to prevent play between the container and closure and ensure axial movement of the closure on the container. The threads may be of square section, rather than conventional "V" section threads to provide maximum stability when the threads first engage, and increasingly thereafter, whereby in conjunction with the four threads as described in U.S. patent application Ser. No. 706,891, the square section thread ensures that the closure is pushed, wound down to its closed position on a parallel plane, thereby making it easier for the engagement of the child-resistant closure in one simple turn of the wrist. The same applies when opening.

According to this further aspect of the invention, there is provided a container and closure therefor wherein the closure and container includes means for retaining the closure in a closed position on the container neck, the closure being a relevant child-resistant closure and the retaining means holding, in use, the closure in the closed position sufficiently strongly for the outer closure part to be rotatable in said other sense relative to said inner closure part when said inner part is in said rest position.

The closure system preferably includes means for ensuring that the closure closes in the same position, every time of closure. This closure system ensures the functioning of the child-resistant closure, whereby when closed, the resistance to opening is sufficiently strong for the child-resistant feature to operate, but is sufficiently weak as to be overcome by the child-resistant system when properly engaged by an adult. The relevant child-resistant closure may be as claimed in U.S. patent application Ser. No. 706,891 (now U.S. Pat. No. 5,213,225), the disclosure of which is incorporated herein by way of reference. This feature provides the advantage that, upon engagement of the closure system, the closure is held on the container such that the child-resistant closure mechanism operates effectively but that the closure can be released, once the closure outer part is moved to the displaced position, by application of a predetermined torque. Conventional spring blades type child-resistant closures are screwed onto a neck thread with more than a 360° turn for closure. In order for all conventional spring blades type child-resistant systms to operate it is essential that they are screwed up very tightly, when being closed, otherwise the child-resistant system does not become operable at all, thus obviating the purpose of the child-resistant system. The weakness of conventional child-resistant systems is therefore obvious, as arthritic, weak and elderly users are unable to close such containers sufficiently tightly, either to close them properly, or, even if they were closed tightly, perhaps by somebody else, then to open them. The preferred embodiment of this invention overcomes this problem, whereby the closure does not have to be closed tightly in order for the child-resistant system to become operable, and therefore is particularly effective for the arthritic, weak and elderly, as this combination of new closure systems enables the containers, bottles and closures to be opened and closed easily, in approximately a quarter of a turn, with an effective child-resistant system.

A still further aspect concerns the combination of a child-resistant closure system, together with a tamper-evident ring. A child-resistant closure has not previously been combined with a tamper-evident ring, because of the difficulty of opening using conventional child-resistant closure systems. According to this aspect of the invention, there is provided a relevant child-resistant closure in combination with a tamper-evident ring. The relevant child-resistant closure is preferably according to one or more aspects of the invention defined herein. Additionally, the closure preferably includes the feature of additional support for the means of opening including upstanding flange, or side flanges, to assist in applying torque when opening the closure.

Preferably, the closure and container neck is as defined in the invention of U.S. patent application Ser. No. 706,891, the disclosure of which is incorporated herein by way of reference, giving the advantage that as the retaining force of the closure system is overcome, and the turning of the closure relative to the container neck starts, combined with the angle of the four threads and the quarter turn required to open, whereby the closure is given sufficient rotational acceleration and thrust to shear through the connections between the tamper-evident ring and the closure in such a manner as to overcome easily the resistance necessary for the tamper-evident ring to be separated from the closure even with the incorporation of the child-resistant system.

In a further aspect the invention provides a container neck and closure therefor, the closure being a said relevant child-resistant closure, the number of said predetermined discrete angular ranges being such that angular displacement of the outer closure member relative to the inner closure member between adjacent positions in which the outer closure member can move to its displaced position is not greater than 45°, the closure including means for biassing rotationally the outer closure part relative to the inner closure part away each angular position at which the outer closure part can move to its displaced position.

In a further aspect the invention provides a container neck and closure, the closure being a said relevant child-resistant closure, the closure having an upstanding diametric handle, the number of said predetermined discrete angular ranges being such that the angular displacement of the outer closure member relative to the inner closure member between adjacent positions in which the outer closure member can move to its displaced position is not greater than about 22.5°, and thereafter the closure can be moved from a fully closed to a fully open position by relative rotation of approximately 90°.

In a further aspect the invention provides a container neck and closure, the closure being a said relevant child-resistant closure, the neck and closure having a tamper-evident ring, and the closure having an upstanding diametric handle, in use, to enable a user to better grip the closure to apply a torque to break the tamper-evident ring.

In a further aspect the invention provides a container neck and closure, the closure being a said relevant child resistant closure, the container and closure having fully engaging thread profiles to prevent play between the container and closure and ensure axial movement of the closure on the container, the closure being movable from a fully opened to a fully closed position by relative rotation of approximately 90°, and the container and closure further comprising retaining means for retaining the closure in the closed position.

In a further aspect the invention provides a relevant child-resistant closure, comprising at least two cantilever leaf springs extending obliquely from one of the inner and outer closure parts towards the other of the parts, each said leaf spring having a cross-section which tapers towards its free end, said other part having a number of angularly spaced ratchet ramps against which leaf springs bear to restrict rotation of the outer closure part relative to the inner closure part in the said one sense, but to permit such rotation in said other sense.

In a further aspect the invention provides a container neck and closure therefor, the closure being a said relevant child-resistant closure, wherein the angular positions at which the outer closure member can move to its displaced position are defined by castellations on each of the inner and outer closure members, there being sixteen equally angularly spaced castellations on at least one of the inner and outer closure members, which castellations mate when the outer closure member is depressed, the closure further comprising resiliently biased ratchet means for biasing the inner and outer closure members apart and for restricting rotation of the outer closure part relative to the inner closure part in the said one sense, but permitting such rotation in the other sense when said castellations are not engaged, said ratchet means further biasing said outer closure member in a rotational direction away from said angular positions at which the outer closure member can move to its displaced position, in use, said closure being movable from a fully open to a fully closed position by relative rotation of approximately 90°, and said container neck and closure further comprising retaining means for holding, in use, the closure in the closed position sufficiently strongly for the outer closure part to be rotatable in said other sense relative to said inner closure part when said inner part is in said rest position.

A preferred embodiment of a closure according to the present invention will now be described with reference to FIGS. 1 to 8 of the accompanying drawings, in which:

FIG. 1 is a longitudinal sectional view of the outer closure part of the closure;

FIG. 2 is an underneath view of the outer closure part of FIG. 1;

Figure 3:
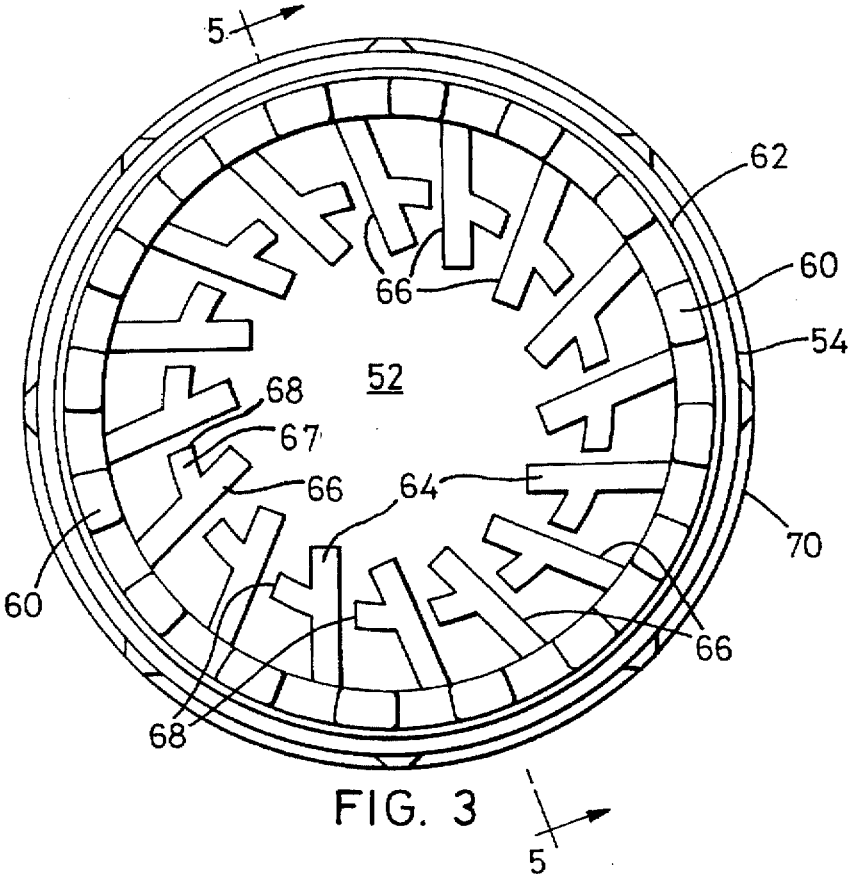
FIG. 3 is a plan view of the inner closure part of the closure.

As can be seen from FIG. 1, an outer closure part 10, constructed of moulded plastics (other suitable materials may be used), consists of a crown portion 12 and a skirt portion 14. The crown portion is provided on its outer surface with a diametric handle 16. The particular form of handle shown includes a central opening 18. Towards the lower, free end of the skirt portion 14, there is provided an inwardly extending bead 20, whose purpose is to retain the outer closure part on the inner closure part as will be described below.

Both FIGS. 1 and 2 illustrate that the inner surface of the crown portion 12 is provided with sixteen equidistant castellations 22 of substantially rectangular form and four equidistant oblique resilient blades 24. The resilient blades 24 extend circumferentially from an upper, left-hand end 26, when viewed from the centre of the closure part, to a lower, right-hand free end 28.

As can be seen from FIGS. 3 to 6, an inner closure part 50, constructed of moulded plastics (other suitable materials may be used), which includes a crown portion 52 and a skirt portion 54. The inner surface of the skirt portion 54 is provided with coarsely pitched threads 56 of square section and a locking element, such as vertical ribs 58, the function and purpose of which are described in detail in U.S. patent application Ser. No. 706,891 now U.S. Pat. No. 5,213,225, whose entire contents are incorporated herein by reference. Vertical ribs 58 engage with a second locking element located on the container neck, such as stop means 92, so that the closure resists loosening at the closed position until a predetermined release torque is applied in a second direction to the inner closure part when the castellation of the inner and outer closure parts are engaged with each other. Obviously the predetermined release torque is greater than the limited frictional torque generated by the resilient blades and the ratchet projections when the outer closure part is rotated in the second direction without the first and second sets of castellations inter-engaging each other. The top of the skirt portion 54 is provided with a tapered surface 59, the function and purpose of which are described in detail in U.S. patent application filed 30th Sep., 1991 corresponding to U.K. Patent Application No. 9114871.8.

Depending from the lower end of the inner closure part skirt portion 54 is a tamper-evident ring 70 which will be described below.

The crown portion 52 is provided around its periphery with sixteen upstanding, substantially rectangular castellations 60. These castellations 6C are adapted to engage the complementary castellations 22 on the outer closure part (see FIG. 2) 10. The outer periphery of the skirt portion 54 includes an outstanding ridge 62 below which, when the inner 50 and outer 10 closure parts are assembled, the bead 20 on the outer closure part 10 is retained. A degree of axial movement of the outer closure part 10 with respect to the inner closure part is permitted to engage and disengage the two sets of castellations 60, 22.

Figure 5:
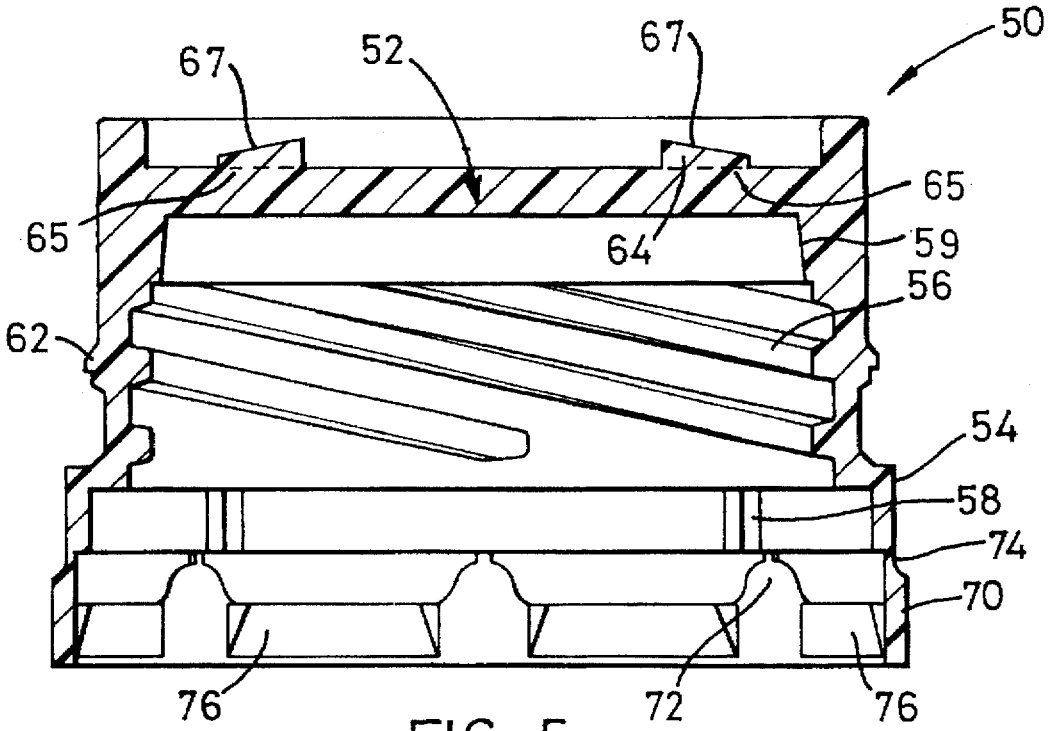
FIG. 5 is a longitudinal sectional view of the inner closure part of FIGS. 3 and 4 taken along section line 5—5 of FIG. 3.

Partly shown in FIG. 5, but fully in FIG. 3, are sixteen equidistant ratchet ramps 64, provided on the upper surface of the inner closure part crown portion 52. When viewed from the centre of the closure part, each ramp 64 is of substantially right triangular section having a horizontal base 65 (denoted by dashed lines), a vertical left-hand side 66 and a hypotenuse 67, terminating in a right-hand side 68.

When the outer closure part 10 is installed on the inner closure part 50, and the outer closure part 10 rotated clockwise, the free ends 28 of the resilient blades 24 abut against the vertical side 66 of their respective ramps, thus rotating the inner closure part 50 with the outer closure part 10. However, assuming that the inner closure part 50 is reasonably tightly held in place, e.g. by a closure torque, then rotation of the outer closure part 10 anticlockwise will merely result in the resilient blades 24 trailing over the ramps 64 in the manner of a ratchet mechanism.

In order for the inner closure part 50 to be rotated anticlockwise, it is necessary for the outer closure part 10 to be depressed against the action of the resilient blades 24 to allow the complementary castellations 22, 60 to engage.

The handle 16 enables the elderly and frail more easily to apply the force required to push down and engage the two parts of the closure, whilst at the same time the handle 16 makes it easy to turn the closure to open it. When closing the same principles and advantages apply. The handle 16 therefore makes the closure much easier to operate, in spite of the child-resistant feature, compared with standard child-resistant closures which many people, not just children find difficult to open.

Alternatively, the handle 16 may be substituted by four side flanges to the outer closure part 10 which again enables easier opening and closing, or a standard cap with ribbed outer edges.

The relative angular displacements at which the complementary castellations 22, 60 may be engaged correspond to positions in which the free ends 28 of the resilient blades 24 have already travelled some distance along and up their respective ramps 64. They therefore correspond to positions of increased potential energy. The resilience of the blades 24 is such that, when the outer closure part 10 is released in such a displacement, the free ends 28 of the blades tend to move back down the sloping surfaces of the ramps 64 to their right hand sides 68. Once this has occurred, the complementary castellations 60, 22 are no longer so oriented as to be immediately engageable with one another.

Thus, all the rotationally stable positions of the outer closure part 10 with respect to the inner closure part 50 correspond to orientations of the castellations 22, 60 in which they cannot immediately be engaged only by depression of the outer closure part 10.

Figure 4:
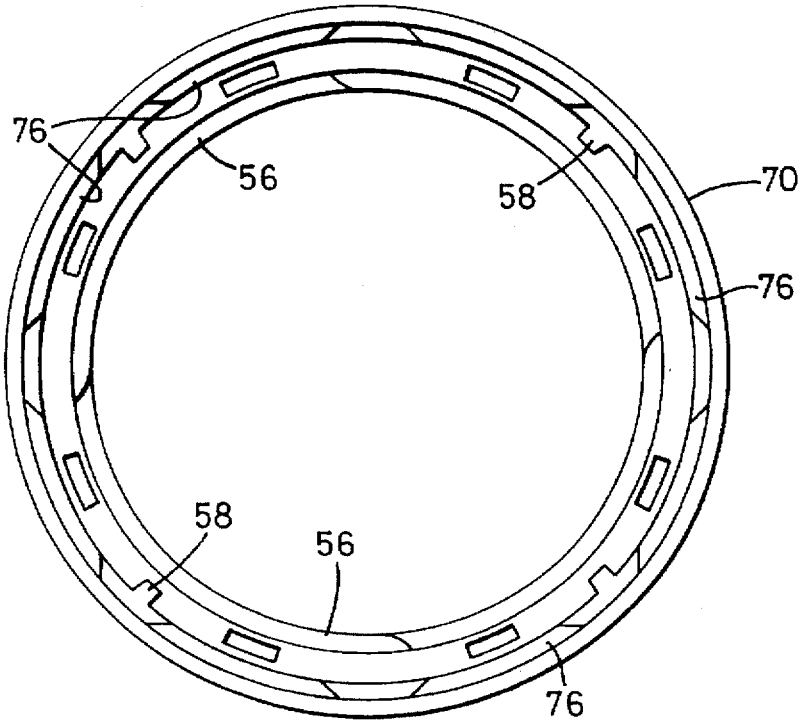
FIG. 4 is an underneath view of the inner closure part of FIG. 3.
Figure 6:
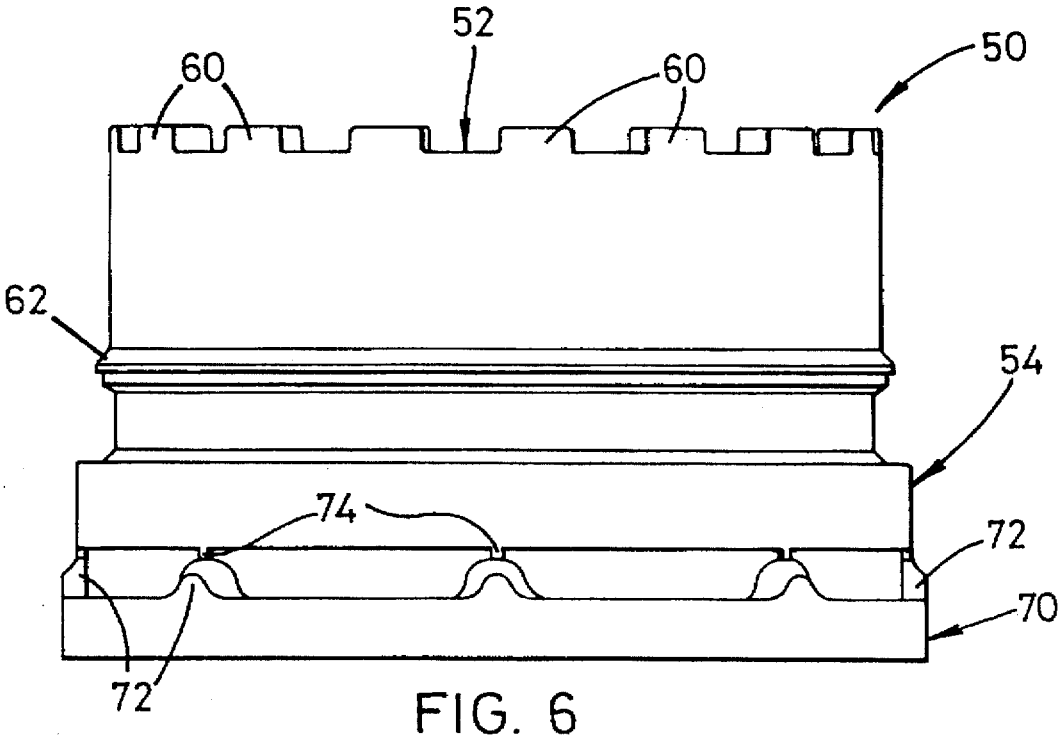
FIG. 6 is a side view of the inner closure part of FIGS. 3 to 5.

The tamper-evident ring 70 carried by the inner closure part 50 is shown in detail in FIGS. 4 to 6. Attached to the top of the ring and integral therewith are eight connecting members 72 which taper upwards from a relatively thick lower region into a relatively thin frangible bridge 74 attached to the inner closure part skirt portion 54. On the inside of the tamper-evident ring 70, extending between the connecting members are eight triangular section ring retaining clips 76 which are adapted to engage a circumferential projection on the outer surface of a container neck.

Figure 7:
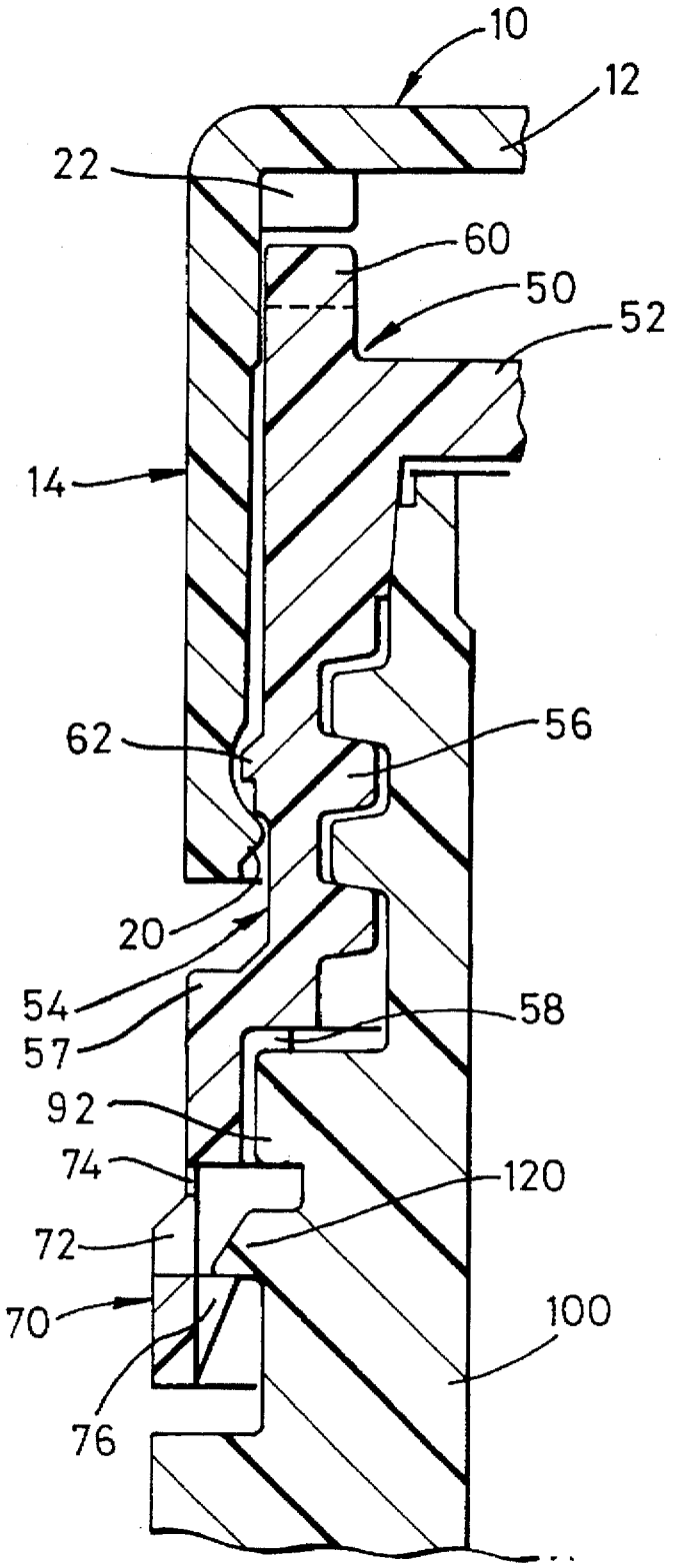
FIG. 7 is a longitudinal sectional view of the assembled closure retained on a container neck.

The assembled closure is shown in FIG. 7, and specific details of the thread 56 and vertical rib 58 and the seal between closure and container 100 may be found in our two Patent specifications cited herein. As can be seen in FIG. 7, the thread is essentially square in section, providing positive and axial alignment of the two closure parts. The container 100 includes an outstanding circumferential projection 120 which is engaged by the ring retaining clips 76. Unscrewing the closure will result in the frangible bridges 74 being stretched and broken.

Figure 8:
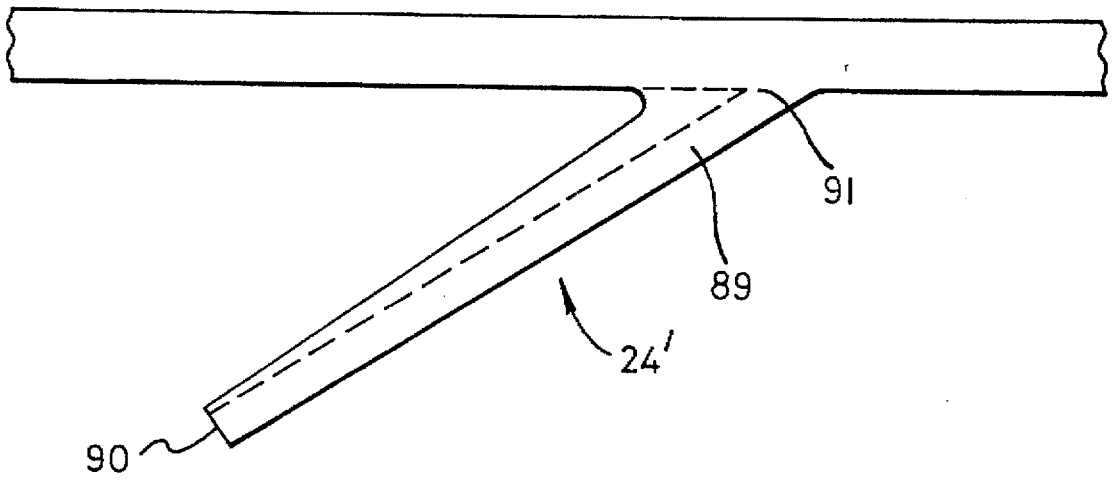
FIG. 8 is a side view showing the profile of a blade in the form of a leaf spring.

FIG. 8 shows a preferred profile of a blade in the form of a leaf cantilever spring 24'.

As can be seen, the leaf spring 24' is thicker at its base 89, becoming progressively thinner towards its free edge 90. The joint 91 of the leaf spring 24' with the remainder of the outer closure part 10 is radiused to provide extra strength. This profile gives sufficient resilience and strength to the leaf spring 24' to ensure that the outer closure part 10 and inner closure part 50 are always separated until axial pressure is applied to counteract the bias of the springs 24'.

An important advantage of this embodiment of the invention is that, in conjunction with features of the container and closure described in PCT/GB91/00850, this is the only child-resistant closure which opens in under half a turn, i.e. 180°, and more generally in approximately a quarter turn i.e. 90° or less, also in conjunction with the container of British Patent Application No. 9114871.8 it is the only child-resistant closure system which can be used in conjunction with either both a tamper-evident ring and a foil seal whereby the seal of the closure is air and liquid proof after the foil has been removed or broken.

This embodiment of the invention is by way of example only; modifications and alterations may be made within the scope of the invention.

I claim:

1. A child resistant closure comprising:

an inner part and an outer part;

co-operating retaining projections on the inner and outer parts for retaining the inner part within the outer part, and for permitting limited axial movement of the inner part within the outer part;

a first set of castellations on the inner part;

a second set of castellations on the outer part arranged to inter-engage the first set of castellations on the inner part when the outer part is moved axially towards the inner part to permit torque to be applied to the inner part;

a set of resilient blades extending from a first of the inner and outer parts towards a second of the inner and outer parts, said resilient blades bearing against said second of said inner and outer parts to urge said inner and outer parts axially away from each other such that said first and second sets of castellations are normally held out of inter-engagement;

each of said resilient blades having a remote end and comprising an abutment surface at said remote end;

said second of said inner and outer parts comprising a set of ratchet projections, each of said ratchet projections comprising a stop surface and a ramp surface, said stop surface being substantially radial and being constructed and arranged to engage the abutment surface of one of said resilient blades when the outer part is rotated in a first direction to apply the closure to a container neck, and each said ramp surface being constructed and arranged to cam one of the resilient blades over said ratchet projection when the outer closure part is rotated in a second direction opposite to said first direction so that said resilient blades will slip relative to the ratchet projections if said outer part is rotated in said second direction without the first and second sets of castellations being in inter-engagement;

wherein said set of resilient blades comprises four of said resilient blades and said set of ratchet projections comprises sixteen of said ratchet projections, said resilient blades being arranged angularly spaced apart from each other and said ratchet projections being arranged angularly adjacent to one another;

said sixteen ratchet projections defining sixteen angular orientations of said outer part relative to said inner part at which said abutment surfaces of said four resilient blades can engage said stop surfaces of said ratchet projections; and wherein said four resilient blades engage a respective four out of said sixteen ratchet projections which are in register with said resilient blades depending on the angular position of said first of said inner and outer parts relative to the second of said inner and outer parts.

2. A child resistant closure according to claim 1, wherein said first set and said second set of castellations each comprise sixteen of said castellations to define sixteen angular orientations of said outer part relative to said inner part at which said first and second sets of castellations can be inter-engaged.

3. A child resistant closure according to claim 1, wherein each resilient blade has a cross-section which tapers towards said remote end, each resilient blade being joined to said first of said inner and outer parts at an acute angle with a radiused profile at said acute angle.

4. A container closure according to claim 1, further comprising an upstanding diametric handle extending from said outer closure part.

* * * * *

UNITED STATES PATENT AND TRADEMARK OFFICE

CERTIFICATE OF CORRECTION

PATENT NO. : 5,676,268
DATED : October 14, 1997
INVENTOR(S) : Roger Milner King

It is certified that error appears in the above-indentified patent and that said Letters Patent is hereby corrected as shown below:

On the Title Page

In column 2, delete

"OTHER PUBLICATIONS

U.S. application Serial No. 08/380,201 filed Jan. 30, 1995 by King (Our Docket No. 4862/26)."

Signed and Sealed this

Twenty-fifth Day of April, 2000

*Attest:*

*Attesting Officer*

Q. TODD DICKINSON

*Director of Patents and Trademarks*